US010539012B2

(12) United States Patent
Donderici et al.

(10) Patent No.: US 10,539,012 B2
(45) Date of Patent: Jan. 21, 2020

(54) PULSED-ELECTRIC DRILLING SYSTEMS AND METHODS WITH FORMATION EVALUATION AND/OR BIT POSITION TRACKING

(71) Applicant: HALLIBURTON ENERGY SERVICES, INC., Houston, TX (US)

(72) Inventors: Burkay Donderici, Houston, TX (US); Ronald J. Dirksen, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 513 days.

(21) Appl. No.: 14/861,896

(22) Filed: Sep. 22, 2015

(65) Prior Publication Data

US 2016/0010450 A1 Jan. 14, 2016

Related U.S. Application Data

(63) Continuation of application No. 13/564,230, filed on Aug. 1, 2012, now Pat. No. 9,181,754.

(Continued)

(51) Int. Cl.

*E21B 49/00* (2006.01)
*E21B 7/15* (2006.01)

(Continued)

(52) U.S. Cl.

CPC ..... *E21B 49/00* (2013.01); *E21B 7/00* (2013.01); *E21B 7/15* (2013.01); *E21B 47/024* (2013.01); *E21B 47/102* (2013.01)

(58) Field of Classification Search

CPC ..... E21B 49/00; E21B 49/003; E21B 49/005

(Continued)

(56) References Cited

U.S. PATENT DOCUMENTS 1,898,926 A 2/1933 Aarts et al.
2,953,353 A 9/1960 Allen (Continued)

FOREIGN PATENT DOCUMENTS

EP 2420358 5/2006
EP 2237075 10/2010

(Continued)

OTHER PUBLICATIONS

Schlumberger Oilfield Glossary entry for "crosswell tomography", accessed Jan. 5, 2018 via www.glossary.oilfield.slb.com.*

(Continued)

*Primary Examiner* — Blake E Michener
(74) *Attorney, Agent, or Firm* — Gilliam IP PLLC

(57) ABSTRACT

Pulsed-electric drilling systems can be augmented with multi-component electromagnetic field sensors on the drill-string, at the earth's surface, or in existing boreholes in the vicinity of the planned drilling path. The sensors detect electrical fields and/or magnetic fields caused by the electrical pulses and derive therefrom information of interest including, e.g., spark size and orientation, bit position, at-bit resistivity and permittivity, and tomographically mapped formation strictures. The at-bit resistivity measurements can be for anisotropic or isotropic formations, and in the former case, can include vertical and horizontal resistivities and an orientation of the anisotropy axis. The sensors can illustratively include toroids, electrode arrays, tilted coil antennas, magnetic dipole antennas aligned with the tool axes, and magnetometers. The use of multiple such sensors increases measurement accuracy and the number of unknown model parameters which can be derived using an iterative inversion technique.

20 Claims, 6 Drawing Sheets

Related U.S. Application Data

(60) Provisional application No. 61/514,349, filed on Aug. 2, 2011.

(51) Int. Cl.
*E21B 47/024* (2006.01)
*E21B 7/00* (2006.01)
*E21B 47/10* (2012.01)

(58) Field of Classification Search
USPC ..... 702/7
See application file for complete search history.

(56) References Cited

U.S. PATENT DOCUMENTS

| | | | | |
|---|---|---|---|---|
| 3,158,207 | A | 11/1964 | Rowley | |
| 3,179,187 | A | 4/1965 | Erich | |
| 3,396,806 | A | 8/1968 | Benson | |
| 3,500,942 | A | 3/1970 | Smith, Jr. | |
| 3,708,022 | A | 1/1973 | Woodruff | |
| 4,390,878 | A | 6/1983 | Harrell | |
| 4,540,127 | A | 9/1985 | Andre | |
| 4,741,405 | A * | 5/1988 | Moeny | E21B 7/15 175/16 |
| 4,956,921 | A | 9/1990 | Coles | |
| 5,064,006 | A | 11/1991 | Waters et al. | |
| 5,250,806 | A | 10/1993 | Rhein-Knudsen et al. | |
| 5,842,149 | A | 11/1998 | Harrell et al. | |
| 6,158,529 | A | 12/2000 | Dorel | |
| 6,206,108 | B1 | 3/2001 | MacDonald et al. | |
| 6,476,609 | B1 | 11/2002 | Bittar | |
| 6,591,920 | B1 | 7/2003 | Foppe | |
| 6,791,469 | B1 | 9/2004 | Rao et al. | |
| 7,147,064 | B2 | 12/2006 | Batarseh et al. | |
| 7,416,032 | B2 | 8/2008 | Money et al. | |
| 8,109,345 | B2 | 2/2012 | Jeffryes | |
| 8,479,841 | B2 | 7/2013 | Rosten | |
| 9,027,669 | B2 | 5/2015 | Dirksen | |
| 9,181,754 | B2 | 11/2015 | Donderici et al. | |
| 2002/0046835 | A1 | 4/2002 | Lee et al. | |
| 2002/0134587 | A1 | 9/2002 | Rester et al. | |
| 2002/0149997 | A1* | 10/2002 | Zhang | G01V 3/28 367/118 |
| 2002/0173913 | A1* | 11/2002 | Tabarovsky | G01V 3/28 702/7 |
| 2002/0173914 | A1* | 11/2002 | Zhang | G01V 3/28 702/7 |
| 2003/0016020 | A1* | 1/2003 | Gianzero | E21B 49/00 324/342 |
| 2003/0076107 | A1 | 4/2003 | Fanini et al. | |
| 2005/0067190 | A1 | 3/2005 | Tabanou et al. | |
| 2005/0150688 | A1 | 7/2005 | MacGregor et al. | |
| 2005/0150692 | A1 | 7/2005 | Ballantyne et al. | |
| 2006/0037516 | A1 | 2/2006 | Moeny | |
| 2006/0137909 | A1 | 6/2006 | Money | |
| 2008/0078580 | A1* | 4/2008 | Bittar | G01V 3/28 175/41 |
| 2008/0245568 | A1 | 10/2008 | Jeffryes | |
| 2008/0255816 | A1 | 10/2008 | Neville | |
| 2009/0050371 | A1 | 2/2009 | Money | |
| 2009/0133929 | A1 | 5/2009 | Rodland | |
| 2009/0200016 | A1 | 8/2009 | Goodwin et al. | |
| 2009/0230968 | A1 | 9/2009 | Bittar et al. | |
| 2010/0000790 | A1 | 1/2010 | Money | |
| 2010/0044102 | A1 | 2/2010 | Rinzler et al. | |
| 2010/0078165 | A1 | 4/2010 | Seleznev et al. | |
| 2010/0212962 | A1* | 8/2010 | Rosten | E21B 7/15 175/40 |
| 2011/0068798 | A1* | 3/2011 | Minerbo | G01V 3/28 324/343 |
| 2011/0185806 | A1* | 8/2011 | Pfutzner | G01V 7/06 73/152.54 |
| 2011/0298461 | A1 | 12/2011 | Bittar et al. | |
| 2012/0067643 | A1 | 3/2012 | Dewitt et al. | |
| 2012/0103693 | A1 | 5/2012 | Jeffryes | |
| 2012/0165997 | A1 | 6/2012 | Lewis et al. | |
| 2012/0168177 | A1 | 7/2012 | Money | |
| 2012/0169841 | A1 | 7/2012 | Chemali et al. | |
| 2012/0186816 | A1 | 7/2012 | Dirksen et al. | |
| 2012/0234605 | A1 | 9/2012 | Donderici et al. | |
| 2012/0255774 | A1 | 10/2012 | Grubb et al. | |
| 2012/0267168 | A1 | 10/2012 | Grub et al. | |
| 2012/0273273 | A1 | 11/2012 | Ligneul et al. | |
| 2013/0008647 | A1 | 1/2013 | Dirksen et al. | |
| 2013/0032397 | A1 | 2/2013 | Dirksen | |
| 2013/0032398 | A1 | 2/2013 | Dirksen | |
| 2013/0032399 | A1 | 2/2013 | Dirksen | |
| 2013/0032400 | A1 | 2/2013 | Dirksen | |
| 2013/0032404 | A1 | 2/2013 | Donderici et al. | |
| 2013/0032406 | A1 | 2/2013 | Comeaux et al. | |
| 2013/0105224 | A1 | 5/2013 | Donderici et al. | |
| 2013/0141102 | A1 | 6/2013 | Donderici et al. | |
| 2016/0010450 | A1 | 1/2016 | Donderici et al. | |

FOREIGN PATENT DOCUMENTS

| | | |
|---|---|---|
| EP | 2554778 | 2/2013 |
| EP | 2554779 | 2/2013 |
| WO | WO-90/05235 | 5/1990 |
| WO | WO-2008/002092 | 1/2008 |
| WO | WO-2008/003092 | 1/2008 |
| WO | WO-2008/097101 | 8/2008 |
| WO | WO-2010/027866 | 3/2010 |
| WO | WO-2011/043851 | 4/2011 |

OTHER PUBLICATIONS

Dictionary definition of "spark", accessed Jul. 26, 2019 via www.thefreedictionary.com.*

EP Extended Search Report, dated Nov. 2, 2015 *Systems and Methods for Directional Pulsed-Electric Drilling* filed Aug. 2, 2012 Appln No. 12179100.8, 8 pgs.

EP Extended Search Report, Feb. 10, 2016, Appl. No. 12178983.8, "*Pulsed-Electric Drilling Systems and Methods with Formation Evaluation and/or Bit Position Tracking,*" Filed Aug. 2, 2012, 8 pgs.

U.S. Non-Final Office Action, dated Apr. 29, 2016, U.S. Appl. No. 13/564,252, "Systems and Methods for Directional Pulsed-Electric Drilling," Filed Aug. 1, 2012, 12.

* cited by examiner

PULSED-ELECTRIC DRILLING SYSTEMS AND METHODS WITH FORMATION EVALUATION AND/OR BIT POSITION TRACKING

RELATED APPLICATIONS

The present application is a continuation of U.S. application Ser. No. 13/564,230, titled "Pulsed-Electric Drilling Systems and Methods with Formation Evaluation and/or Bit Position Tracking" and filed Aug. 1, 2012, which in turn claims priority to U.S. Application 61/514,349, titled "Pulsed-electric drilling systems and methods with formation evaluation and/or bit position tracking" and filed Aug. 2, 2011 by Burkay Donderici and Ron Dirksen. Both of the foregoing references are hereby incorporated herein by reference. The present application further relates to co-pending U.S. application Ser. No. 13/564,252, titled "Systems and methods for pulsed-electric drilling" and filed Aug. 1, 2012 by Ron Dirksen.

BACKGROUND

There have been recent efforts to develop drilling techniques that do not require physically cutting and scraping away material to form the borehole. Particularly relevant to the present disclosure are pulsed electric drilling systems that employ high energy sparks to pulverize the formation material and thereby enable it to be cleared from the path of the drilling assembly. Illustrative examples of such systems are disclosed in: U.S. Pat. No. 4,741,405, titled "Focused Shock Spark Discharge Drill Using Multiple Electrodes" by Moeny and Small; WO 2008/003092, titled "Portable and directional electrocrushing bit" by Moeny; and WO 2010/027866, titled "Pulsed electric rock drilling apparatus with non-rotating bit and directional control" by Moeny. Each of these references is incorporated herein by reference.

Generally speaking, the disclosed drilling systems employ a bit having multiple electrodes immersed in a highly resistive drilling fluid in a borehole. The systems generate multiple sparks per second using a specified excitation current profile that causes a transient spark to form and arc through the most conducting portion of the borehole floor. The arc causes that portion of the borehole floor to disintegrate or fragment and be swept away by the flow of drilling fluid. As the most conductive portions of the borehole floor are removed, subsequent sparks naturally seek the next most conductive portion.

These systems have the potential to make the drilling process faster and less expensive. However, there are only a limited number of existing logging while drilling techniques that may be suitable for use with the new drilling systems.

BRIEF DESCRIPTION OF THE DRAWINGS

Accordingly, there are disclosed herein in the drawings and detailed description specific embodiments of pulsed-electric drilling systems and methods with formation evaluation and/or bit position tracking. In the drawings.

Figure 1:
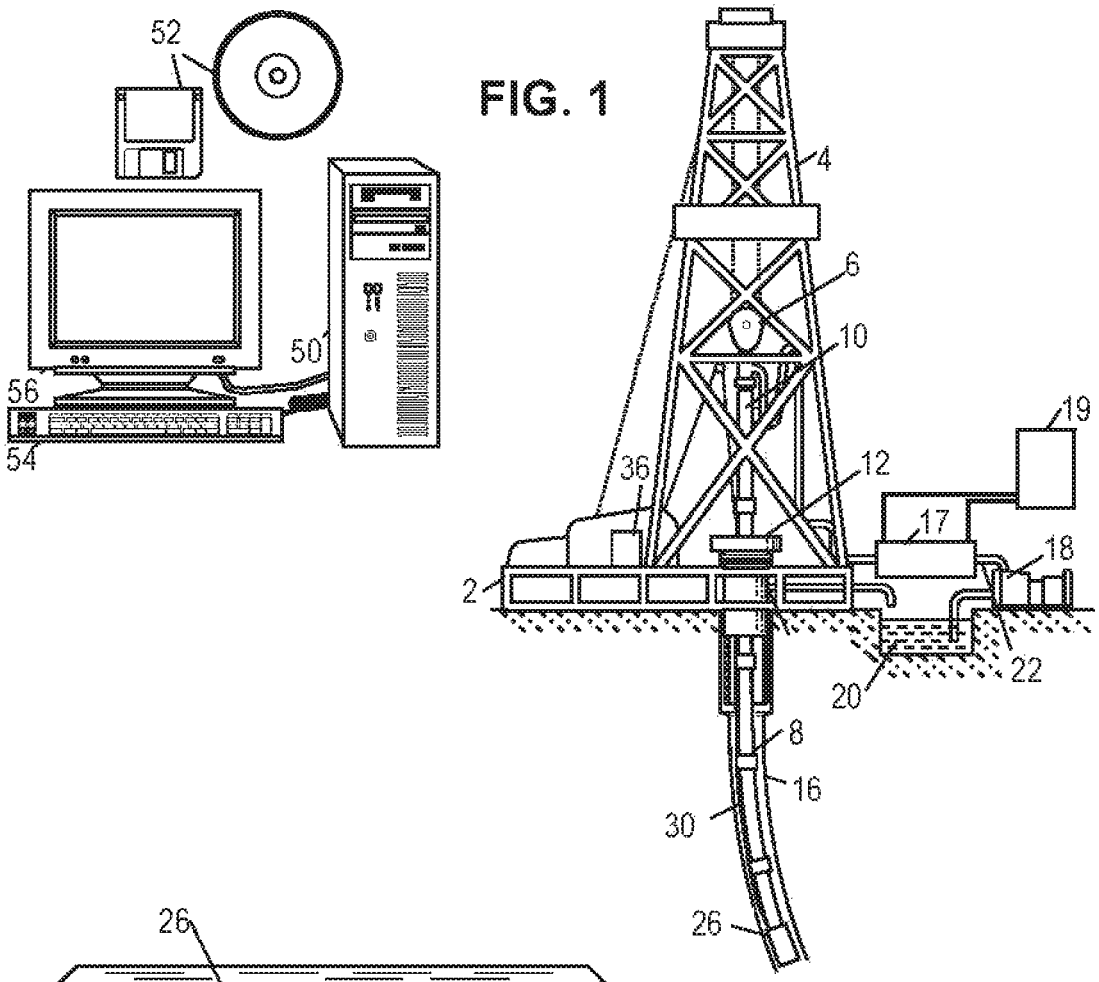
FIG. 1 shows an illustrative (LWD) environment.

It should be understood, however, that the specific embodiments given in the drawings and detailed description do not limit the disclosure. On the contrary, they provide the foundation for one of ordinary skill to discern the alternative forms, equivalents, and modifications that are encompassed in the scope of the appended claims.

DETAILED DESCRIPTION

The disclosed embodiments can be best understood in the context of their environment. Accordingly, FIG. 1 shows a drilling platform 2 supporting a derrick 4 having a traveling block 6 for raising and lowering a drill string 8. A drill bit 26, which may be part of a pulsed-electric drilling system as patented by Tetra (see references cited in background), is powered via a wireline cable 30 to extend borehole 16. Power to the bit is provided by a power generator and power conditioning and delivery systems to convert the generated power into multi-kilovolt DC pulsed power required for the system. This would likely be done in several steps, with high voltage cabling being provided between the different stages of the power-conditioning system. The power circuits will generate heat and will likely be cooled during their operation to sustain operation for extended periods.

Recirculation equipment 18 pumps drilling fluid from a retention pit 20 through a feed pipe 22 to kelly 10, downhole through the interior of drill string 8, through orifices in drill bit 26, back to the surface via the annulus around drill string 8, through a blowout preventer and along a return pipe 23 into the pit 20. The drilling fluid transports cuttings from the borehole into the pit 20, cools the bit, and aids in maintaining the borehole integrity. A telemetry interface 36 provides communication between a surface control and monitoring system 50 and the electronics for driving bit 26. A user can interact with the control and monitoring system via a user interface having an input device 54 and an output device 56. Software on computer readable storage media 52 configures the operation of the control and monitoring system.

The feed pipe 22 may optionally be equipped with a heat exchanger 17 to remove heat from the drilling fluid, thereby cooling it before it enters the well. A refrigeration unit 19 may be coupled to the heat exchanger 17 to facilitate the heat transfer. As an alternative to the two-stage refrigeration system shown here, the feed pipe 22 could be equipped with air-cooled radiator fins or some other mechanism for transferring heat to the surrounding air. It is expected, however, that a refrigerant vaporization system would be preferred for its ability to remove heat efficiently even when the ambient temperature is elevated.

Figure 2:
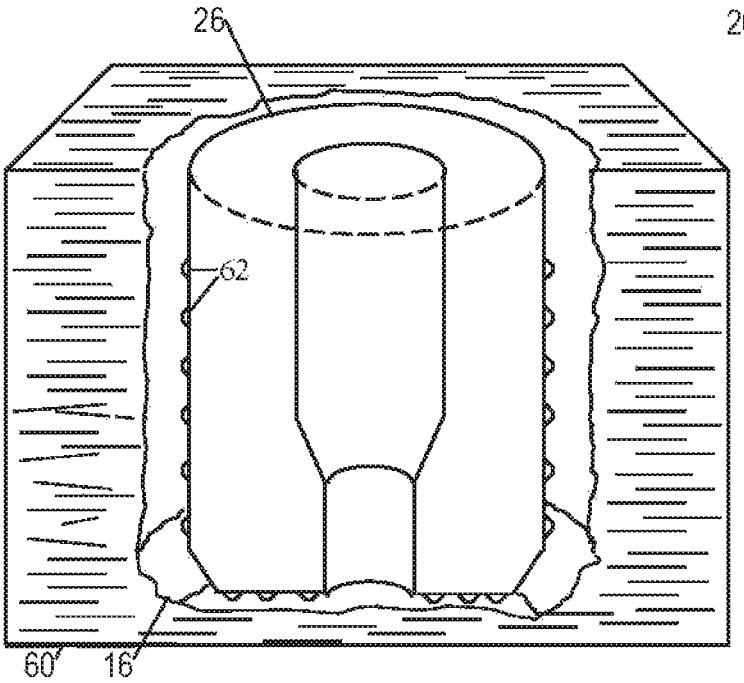
FIG. 2 is a detail view of an illustrative drill bit.

FIG. 2 shows a close-up view of an illustrative formation 60 being penetrated by drill bit 26. Electrodes 62 on the face of the bit provide electric discharges to form the borehole 16. A high-permittivity, high-resistivity fluid drilling fluid flows from the bore of the drill string through one or more ports in the bit to pass around the electrodes and returns along the annular space around the drillstring. The fluid serves to communicate the electrical discharges to the formation and to cool the bit and clear away the debris.

Figure 3:
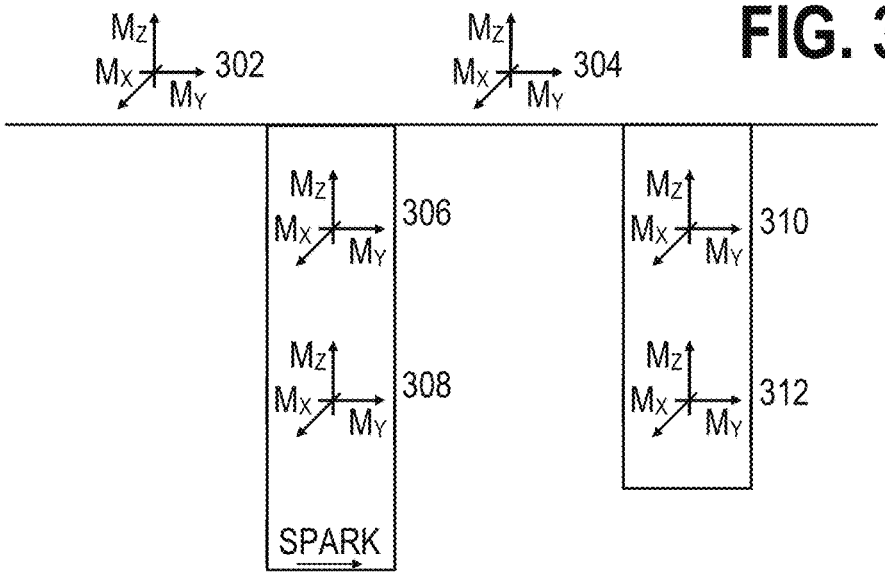
FIG. 3 shows potentially suitable electromagnetic sensor locations.

FIG. 3 shows a borehole with an illustrative spark at the bottom of a borehole. From more than a few feet away, the current pulse can be approximated as a point dipole having a position, magnitude, and direction. (Each of these characteristics is expected to vary from spark to spark, and may potentially vary during any given spark.) The (transient) point dipole generates an electromagnetic field which interacts with the surrounding formation. Nearby sensors can be used to measure the electromagnetic fields and provide sufficient information to (1) determine the characteristics of the point dipole, including its position, and (2) measure various formation characteristics including formation resistivity, permittivity, and anisotropy.

The illustrative sensors in FIG. 3 are tri-axial magnetic field sensors. Examples of such sensors include flux gate magnetometers, rotating magnetometers, and loop antennas. Alternatively, or in addition, one or more of the sensors may be tri-axial electric field sensors. Examples of such sensors include monopole antennas, dipole antennas, and spaced-apart electrodes. While tri-axial sensors are preferred, it is not strictly necessary that all or any of the sensors be tri-axial or even multi-axial.

FIG. 3 shows illustrative sensors 302, 304 as being positioned on or near the earth's surface. Care should be taken to avoid electromagnetic interference from surface equipment, and to that end, the sensors may be buried and, if necessary, shielded from above-ground fields. Also shown are illustrative sensors 306, 308 positioned in the same borehole as the bit, e.g., integrated into the drill string. Further, illustrative sensors 310, 312 are shown positioned in an existing borehole spaced apart from the borehole being drilled. The number and position (and type) of sensors is expected to be varied based on circumstances and desired information. For measuring formation characteristics in the neighborhood of the drill bit, drillstring-positioned sensors 306, 308 are expected to be most useful, though a sensor array in an existing borehole (sensors 310, 312) can also provide some sensitivity to these characteristics. For measuring deeper formation characteristics, the existing borehole sensor array (310, 312) is expected to be most useful, though sensors 302-308 would also demonstrate some sensitivity. Finally, for tracking the position of the bit during the drilling process, surface sensors 302, 304 are expected to be most useful, though sensors 310, 312 in an existing borehole could also be useful.

Figure 4A:
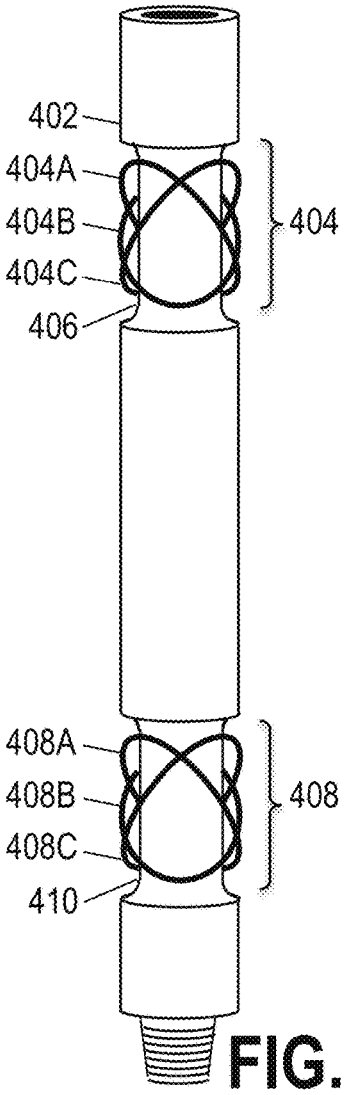
FIG. 4A shows an illustrative LWD tool having multi-axis magnetic dipole sensors.

FIG. 4A shows an illustrative logging while drilling (LWD) tool 402 having two tri-axial magnetic field sensors 404, 408. Sensor 404 has three tilted loop antennas 404A, 404B, and 404C, in a circumferential recess 406, each antenna tilted at about 54° from the tool axis at azimuths spaced 120° apart to make the antennas orthogonal to each other. Similarly, sensor 408 has tilted loop antennas 408A-408C arranged in a circumferential recess 410. A non-magnetic, insulating filler material may be employed to support and protect the loop antennas in their recesses. Note that the antennas need not be orthogonal to each other, nor is their configuration limited to the use of tilted antennas. Co-axial and transverse loop antennas are known in the art and may also be suitable.

Figure 4B:
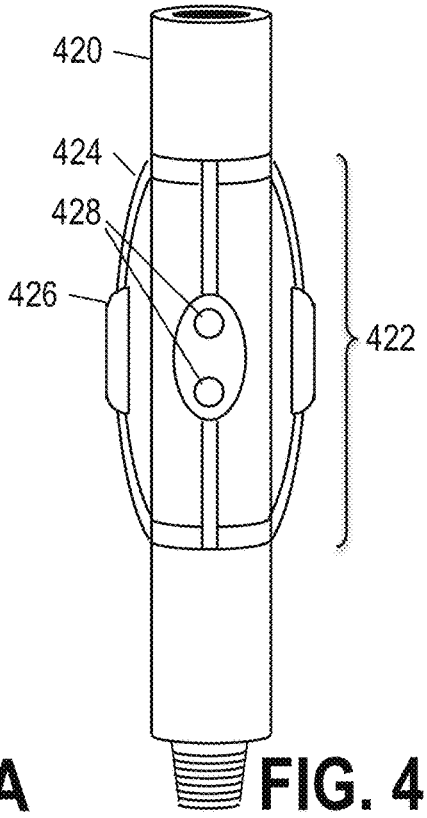
FIG. 4B shows an illustrative LWD tool having spaced electrodes for multi-axis electric field sensing.

FIG. 4B shows an illustrative LWD tool 420 having a centralizer 422 that enables triaxial electric field measurements. Centralizer 422 includes four spring arms 424 (one is hidden from view in FIG. 4B), each spring arm having a wall-contacting pad 426, and each pad 426 having at least two electrodes 428 spaced apart along the tool axis. It should be noted here that electrodes 428 can also be spaced apart azimuthally or along any other direction on the same pad for realizing a dipole of different orientations. The electrodes are kept in close contact with the wall, enabling voltage measurements at points that are spaced apart along three axes.

The examples given in FIGS. 4A-4B are merely illustrative and are not intended to be limiting on the scope of the disclosure. In some system configurations, the component of the field along the tool axis may be expected to be negligible, and the sensors may accordingly be simplified by eliminating measurements along this axis. As one example, each pad 426 in FIG. 4B could be provided with a single electrode 428.

Figure 5:
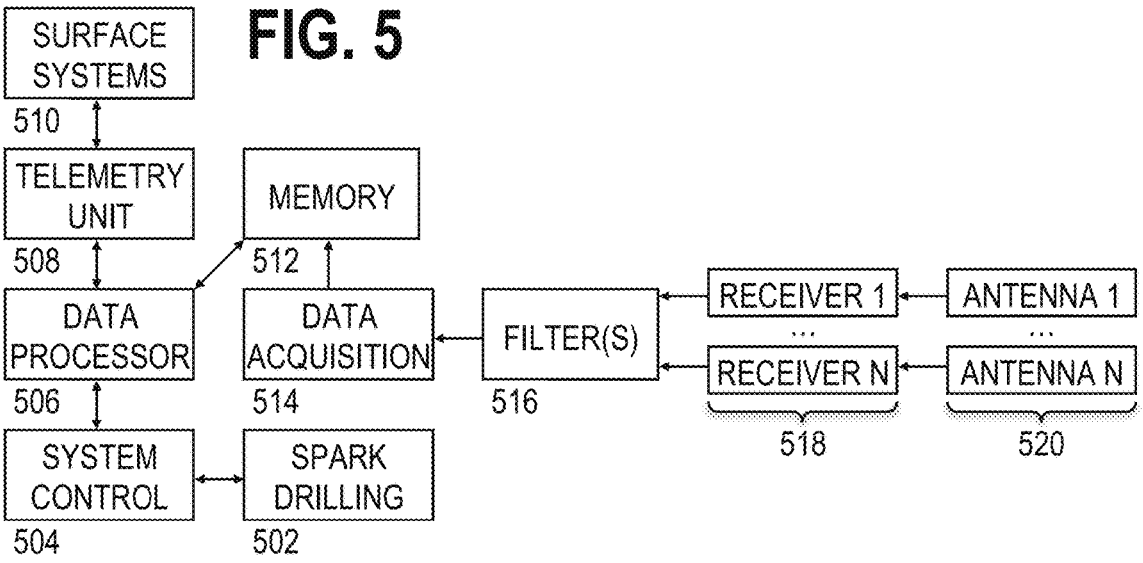
FIG. 5 is a function-block diagram of illustrative tool electronics.

FIG. 5 is a function-block diagram of illustrative LWD tool electronics. A pulsed-electric drill bit 502 is driven by a system control center 504 that provides the switching to generate and direct the pulses between electrodes, monitors the electrode temperatures and performance, and otherwise manages the bit operations associated with the drilling process (e.g., creating the desired transient signature of the spark source). System control center is comprised of either a CPU unit or analog electronics designed to carry out these low level operations under control of a data processing unit 506. The data processing unit 506 executes firmware stored in memory 512 to coordinate the operations of the other tool components in response to commands received from the surface systems 510 via the telemetry unit 508.

In addition to receiving commands from the surface systems 510, the data processing unit 506 transmits telemetry information collected sensor measurements and performance of the drilling system. It is expected that the telemetry unit 508 will communicate with the surface systems via a wireline, optical fiber, or wired drillpipe, but other telemetry methods can also be employed. Loop antennas 520 or other electromagnetic signal sensors provide small voltage signals to corresponding receivers 518, which amplify, filter, and demodulate the signals. One or more filters 516 may be used to condition the signals for digitization by data acquisition unit 514. The data acquisition unit 514 stores digitized measurements from each of the sensors in a buffer in memory 512.

Data processing unit 506 may perform digital filtering and/or compression before transmitting the measurements to the surface systems 510 via telemetry unit 508. The received transient signal can be digitized and recorded as a function of time, and it can be later converted to frequency with a Fourier transform operation. It can be alternatively passed through an analog band-passed filter and only response at a discrete set of frequencies is recorded. The strength of the signal at any given frequency is a function of the intensity and duration of the transient pulse applied to the spark system. Both the reception frequency band of operation and the intensity and timing of the spark system can be adjusted to optimize intensity and quality of the signal received. This optimization may be performed by analyzing the Fourier transform of the spark activation pulse and operating near the local maxima of the spectrum magnitude.

In some embodiments, the buttonhole assembly further includes a steering mechanism that enables the drilling to progress along a controllable path. The steering mechanism may be integrated into the system control unit 504 and hence operated under control of data processing unit 506 in response to directives from the surface systems 510.

The operation of the receivers 518 and data acquisition unit 514 can be synchronous or asynchronous with the electrical pulse generation. Though synchronization adds complexity to the system, it can increase signal-to-noise ratio and enable accurate signal phase measurements. In an asynchronous approach, these issues can be addressed through the use of multiple receivers and combining their measurements. Rather than measuring attenuation and phase shift between the transmitted signal and the received signal, the tool can measure attenuation and phase shift between signals received at different points.

In at least some embodiments, the system obtains two types of data: electric/magnetic data from the receivers; and voltage, current and transmitting and receiving electrode position data from the spark system. In same-well operations, the will bit position relative to receiver position is usually known. In other operations (cross-well tomography, bit position tracking from the surface), the drill bit position relative to the receivers can be derived. Once the drill bit position is known, this data can be used to solve for spark properties (magnitude and orientation) and formation properties (resistivity, permittivity, anisotropy azimuth, anisotropy elevation).

Figure 6:
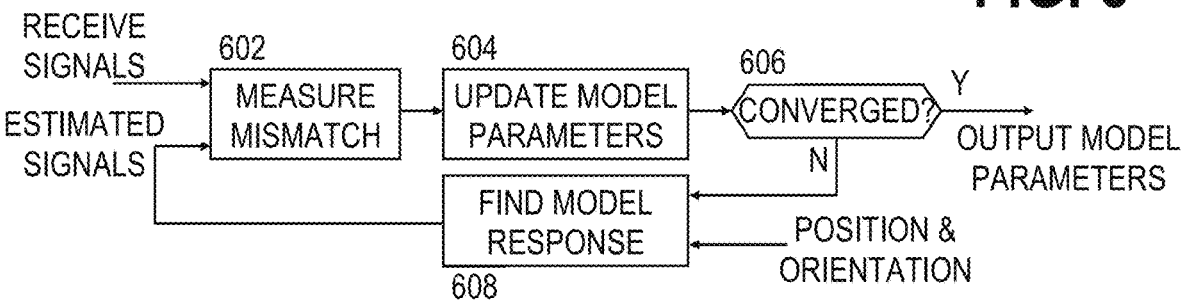
FIG. 6 is a flowchart of an illustrative inversion method.

Approximate closed form solutions can be used to obtain the desired properties, but a preferred approach is iterative inversion as shown in FIG. 6. While it is feasible in some cases to perform the inversion in a downhole processor, it is expected that in most cases a general purpose data processing system on the surface (e.g., monitoring system 50 in FIG. 1) will perform the inversion. In block 602, the system determines a mismatch between the signals measured by the sensors at a given time and a set of estimated signals. (The estimated signals are derived iteratively as explained further below, and they may be initially set at zero, an average value, or values determined tar the sensor signals at a preceding time point.) In block 604, the system uses the measured mismatch to determine a model parameter update. Any of various adaptation algorithms can be used for this step, including gradient descent, Gauss-Newton, and Levenberg-Marquardt. As discussed further below, the adjustable model parameters may vary depending on the configuration of the system, but may include the spark properties, formation properties, and optionally the bit position relative to the receivers.

In block 606 the system determines whether the iterative procedure has converged. For example, if the updates to the model parameters are negligible, the system may terminate the loop and output the current model parameter values. In addition, or alternatively, the system may limit the number of iterations to a predetermined amount, and produce the model parameter values that have been determined at that time. Otherwise, in block 608, the system employs current values of the model parameters, including where applicable the known or measured bit position and orientation, to determine the expected receive signals. This determination can be done using a simulation of the system, but in most cases the system can employ a library of pre-computed values using interpolation where needed. The expected receive signals for the current model parameters are then compared to the measured receive signals in block 602, and the process is repeated as needed to reduce the degree of mismatch.

In some embodiments, the position of the bit relative to the receive antennas is known, and the system operates on the voltage, current, and electrode position data from the spark system at the bit, and on the receive signals which indicate magnetic and/or electric field components, to determine the horizontal and vertical resistivities of the formation as well as the azimuth and elevation of the formation anisotropy axis. In other embodiments, the system further solves for spark orientation and magnitude.

In still other system embodiments, the formation around the bit is treated as being isotropic, making it possible to simplify the inversion process. The signal variations due to spark orientation and intensity can be compensated by first calculating the magnitude of the measured magnetic/electric field vector (expressible as a complex voltage in phasor form) at each of the receivers by taking the square root of the sum of squares of the spatially orthogonal components.

This operation eliminates the orientation dependence. To eliminate the spark strength dependence, the system takes the ratio of the vector magnitudes (which are expressible as complex voltages in phasor form) from different receivers. The inversion can then take this ratio as the basis for inversion to find the formation resistivity. In this case, the solution space is small enough that the formation resistivity can usually be obtained using a reasonably-sized table to map the ratio to the formation resistivity.

Figure 7A:
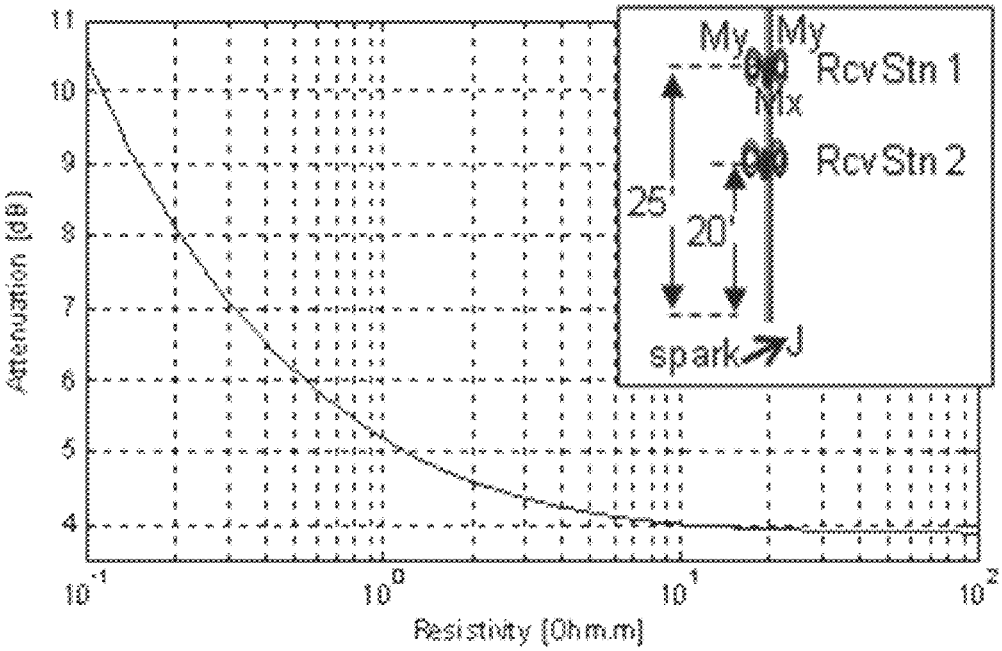
FIGS. 7A-7B are graphs of magnetic dipole signal attenuation and phase as a function of formation resistivity.
Figure 7B:
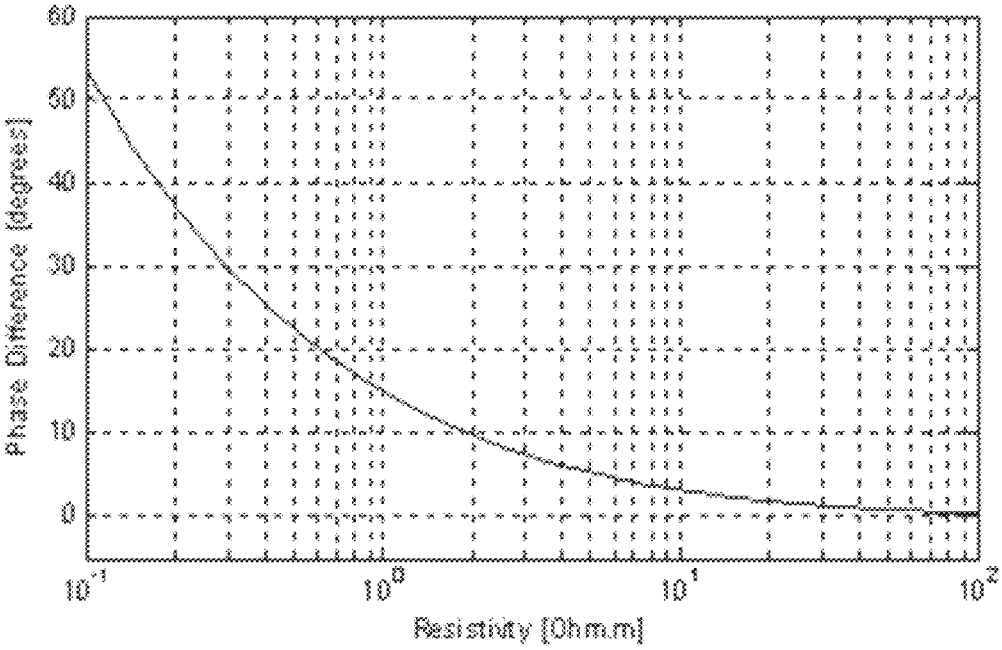

FIGS. 7A-7B summarize the table that would be used to map a ratio to an isotropic formation resistivity in a system having a first transverse-component magnetic field sensor (with antennas to measure Mx and My) positioned 25 feet away from the drill bit, and a second, similar sensor positioned 20 feet away, as indicated in the inset figure in FIG. 7A. FIG. 7A shows the ratio magnitude on a logarithmic scale (attenuation in dB) as a function of resistivity, also on a logarithmic scale. FIG. 7B shows the phase of the ratio, which is the phase difference between the measured fields, as a function of resistivity. Either FIG. 7A or FIG. 7B could be used alone to derive a formation resistivity estimate from the ratio, but in many cases they would each be used and the formation resistivity estimates averaged or combined together in some other way.

Figure 8A:
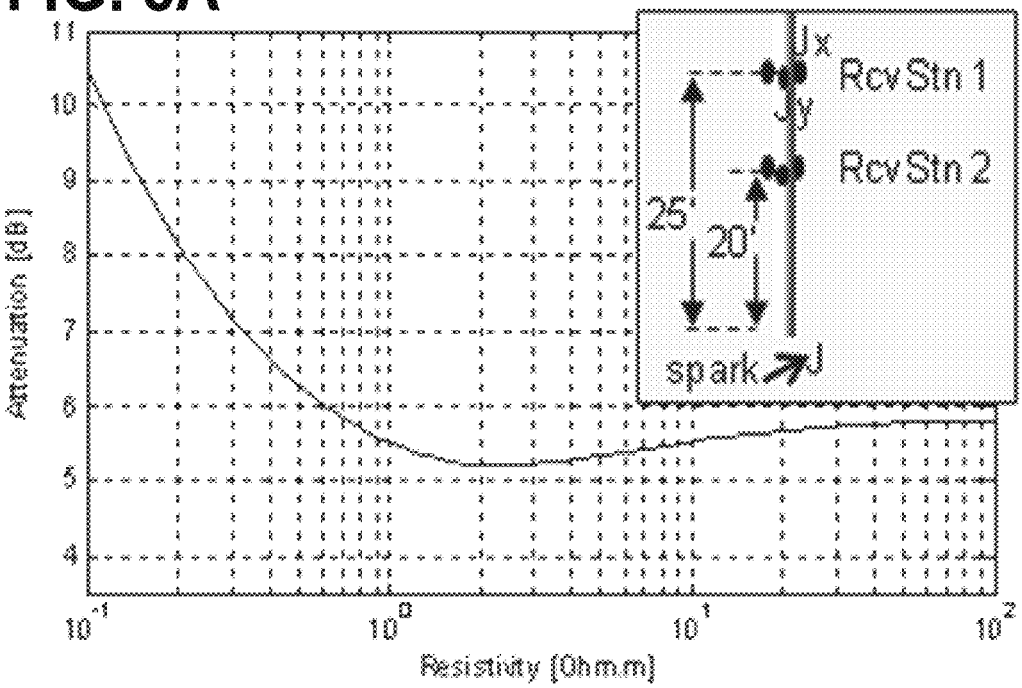
FIGS. 8A-8B are graphs of electric dipole signal attenuation and phase as a function of formation resistivity.
Figure 8B:
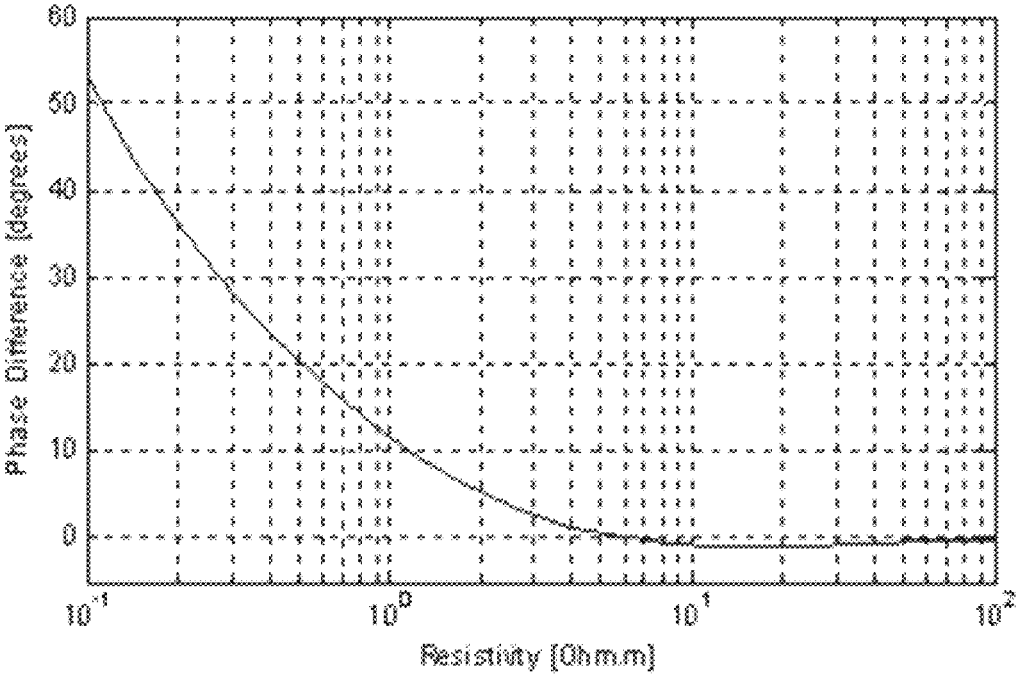

If instead of transverse component magnetic field sensors, the system employs transverse component electric field sensors at the foregoing locations, as indicated by the inset in FIG. 8A, the magnitude and phase of the ratio as a function of formation resistivity would be as shown in FIGS. 8A and 8B. Since the curves in FIG. 8 are not monotonic, it would likely be necessary to use both magnitude and phase to unambiguously determine formation resistivity. (In both FIGS. 7A-7B and 8A-8B, the electromagnetic calculations are performed assuming a 10 kHz signal frequency.)

Figure 9A:
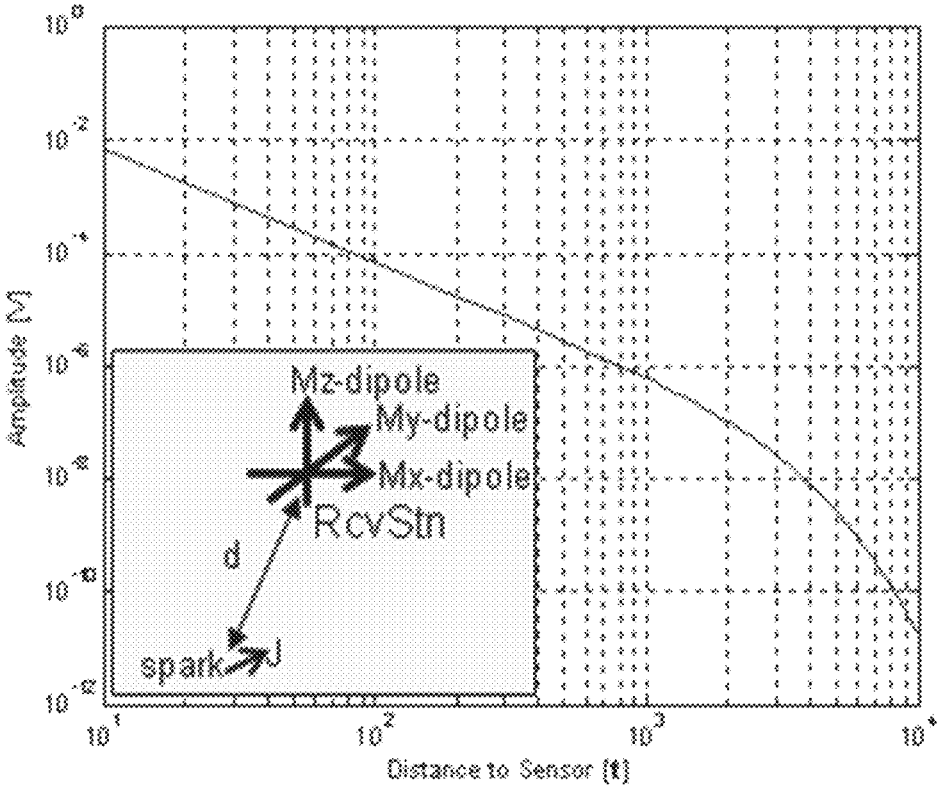
FIGS. 9A-9B are graphs of magnetic and electric dipole signal amplitude as a function of distance to the bit.
Figure 9B:
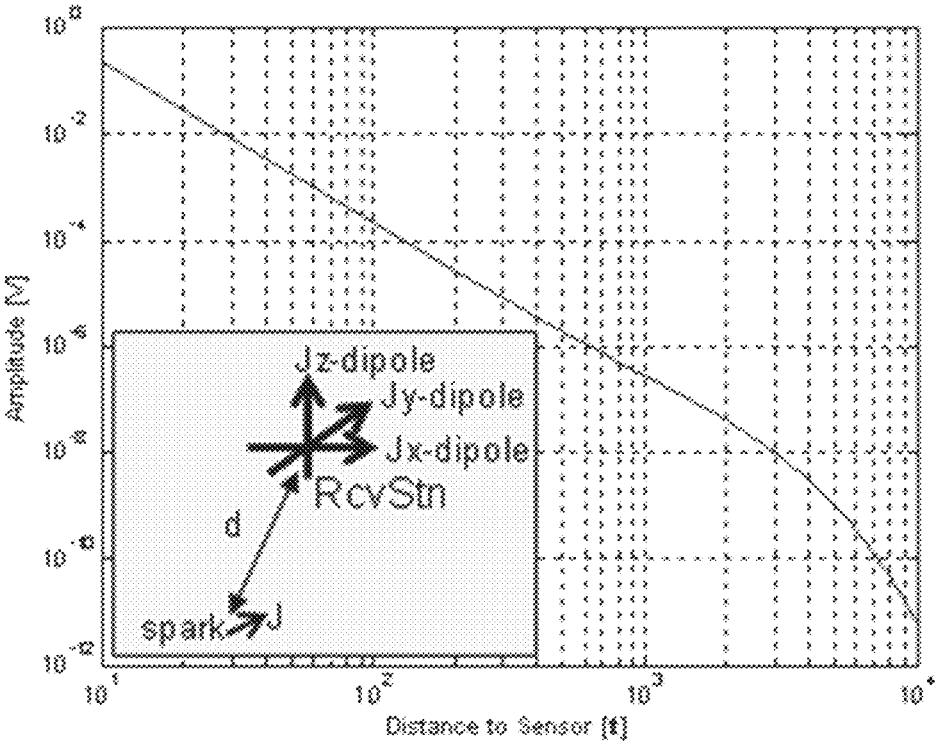

To illustrate the suitability of the disclosed systems for tracking the drill bit position, FIG. 9A shows the signal magnitude received by a triaxial magnetic field sensor as a function of sensor distance from the bit (each sensor antenna being equivalent to a 10,000-turn coil with a 20 inch diameter), while FIG. 9B shows the signal magnitude received by a triaxial electric field sensor as a function of sensor distance (each sensor antenna being equivalent to electrodes spaced 10 feet apart). In both cases here, the electromagnetic calculations are performed assuming a 2 Hz signal Under these assumptions, the signals should be detectable at a range of up to 2000 feet. With multiple such sensors ranging to the bit from the surface and/or existing boreholes, it becomes possible to triangulate the bit position and monitor the drilling progress.

Moreover, with enough sensors arranged in a suitable array, it becomes possible to perform tomographic calculations to discern subsurface bedding, faults, and other structures, along with their associated resistivities. With such information, the drilling path relative to such structures can be monitored and controlled.

Figure 10:
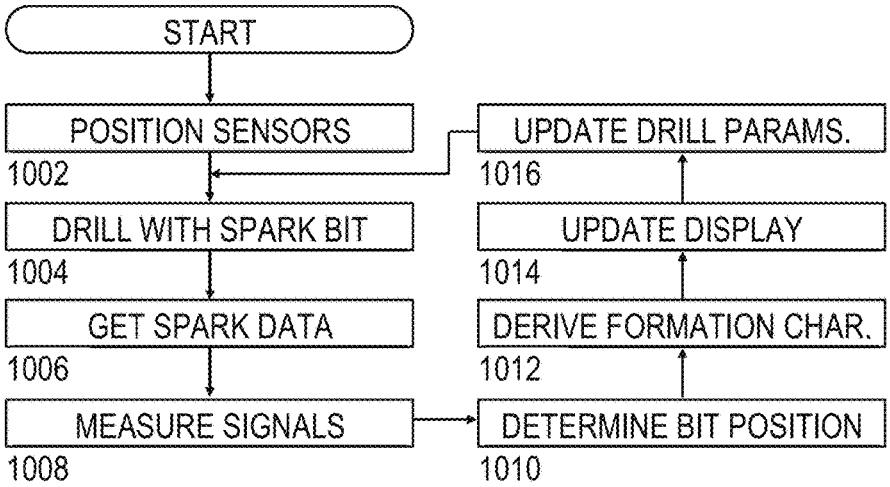
FIG. 10 is a flowchart of an illustrative formation evaluation and/or bit position tracking method.

FIG. 10 is a flowchart of an illustrative formation evaluation and/or bit position tracking method. The method begins in block 1002 with the positioning of the sensors, e.g., in the drill string, on the surface above the planned drilling path, and in nearby boreholes. The sensor positions are carefully, determined and kept for use during the inversion process. In block 1004 the drillers begin pulsed-electric drilling operations. In block 1006, the system captures the spark data, such as the current and voltage of the generated arc, and optionally the source and sink electrodes as well. The system may further capture information from the bottomhole assembly's position tracking systems regarding the position and orientation of the bit.

In block 1008, the system measures the receive signals indicative of magnetic and/or electric field components at each of the sensor positions. In block 1010 the system optionally derives the bit position, arc strength, and arc orientation from the receive signals. This information may be used to verify or enhance whatever information has already been collected from the bottom hole assembly regarding these parameters. With these parameters having been determined, subsequent inversion operations will benefit from the reduced number of unknowns. In block 1012, the system inverts the receive signals to derive formation characteristics such as resistivity, anisotropy, direction of anisotropy, and permittivity. The measurements are expected to be most sensitive to the characteristics of the formation in the immediate vicinity of the bit, but tomographic principles can be employed to extract formation characteristics at some distance from the bit.

In block 1014, the system displays the derived information to a user, e.g., in the form of a formation resistivity log and/or a current position of the bit along a desired path. The display can be updated in real time as the measurements come in, or derived from previously acquired measurements and displayed as a finished log. Where the system is operating in real time, the system updates the drilling parameters in block 1016, e.g., steering the drillstring within a formation bed, adjusting the electric pulse characteristics to match the formation parameters, etc. Blocks 1004-1016 are repeated as new information is acquired.

The tools and methods disclosed here employ magnetic and electric receivers, measuring their responses to signals created by an electric spark drilling system for formation evaluation, ranging and positioning. Use of spark drilling signals eliminates the need for using a separate transmitter. Since the signals created by drilling are very large, they can not only be used for small range applications such as evaluating rocks around the borehole, but also in tomography and positioning. Existing electromagnetic logging tools may be used with no or little modifications to detect electric spark signals.

Numerous variations and modifications will become apparent to those skilled in the art once the above disclosure is fully appreciated. For example, the sensors described herein can be implemented as logging while drilling tools and as wireline logging took. Resistivity can be equivalently measured in terms of its reciprocal, conductivity, or generalized to include complex impedance or admittance measurements. The choice of which parameters are fixed and which are used in the inversion depends on which parameters are available in a particular situation. It is intended that the following claims be interpreted to embrace all such variations and modifications where applicable.

What is claimed is:

1. A pulsed-electric drilling system that comprises:

a drillstring terminated by a bit that extends a borehole through a formation ahead of the bit by passing pulses of electrical current into the formation;

one or more multi-component electromagnetic field sensors positioned on the drillstring, wherein the one or more multi-component electromagnetic field sensors comprises a set of sensing elements to measure fields, and wherein the set of sensing elements have at least one sensing element that is at a different axial orientation than another sensing element of the set of sensing elements, and wherein the fields are caused by the pulses of electrical current originating at the bit; and a processor that receives measurements representative of the fields measured by each of the set of sensing elements and derives, based at least in part on the measurements representative of the fields, a spark orientation at the bit and at least one electrical property of the formation.

2. The system of claim 1, wherein deriving the at least one electrical property comprises deriving a resistivity based on a signal phase and a signal ratio, wherein the signal phase is a phase difference between a first field measurement and a second field measurement, and wherein the signal ratio is a ratio of a magnitude of the first field measurement and a magnitude of the second field measurement, and wherein both the first field measurement and the second field measurement are complex measurements and are part of the measurements representative of the fields.

3. The system of claim 1, wherein the at least one electrical property comprises an isotropic formation resistivity, and wherein as part of deriving the isotropic formation resistivity, the processor determines a magnitude of the fields at each of the one or more multi-component electromagnetic field sensors.

4. The system of claim 1, wherein the at least one electrical property comprises anisotropic components of a formation resistivity and an orientation of an anisotropy axis.

5. The system of claim 1, wherein the at least one electrical property comprises a complex impedance or admittance.

6. The system of claim 1, wherein the one or more multi-component electromagnetic field sensors measure magnetic fields.

7. The system of claim 1, wherein the one or more multi-component electromagnetic field sensors measure electrical fields.

8. The system of claim 1, wherein the one or more multi-component electromagnetic field sensors is a first set of multi-component electromagnetic field sensors, and wherein the system further comprises a second set of multi-component electromagnetic field sensors positioned in an additional well or borehole, and wherein the processor performs a cross-well tomography analysis based at least in part on measurements by the first set of multi-component electromagnetic field sensors and the second set of multi-component electromagnetic field sensors.

9. The system of claim 1, wherein the one or more multi-component electromagnetic field sensors is a first set of multi-component electromagnetic field sensors, and wherein the system further comprising an alternate set of multi-component electromagnetic field sensors positioned on or near the earth's surface, and wherein the processor derives a position of the bit based at least in part on measurements by the first set of multi-component electromagnetic field sensors and the alternate set of multi-component electromagnetic field sensors.

10. The system of claim 1, wherein the set of sensing elements comprises at least three antennas, wherein each of the at least three antennas have a different axial orientation from each other.

11. A pulsed-electric drilling method that comprises:

extending a borehole through a formation in front of a bit by passing pulses of electrical current into the formation;

acquiring measurements of electromagnetic fields using each of a set of sensing elements, wherein at least one sensing element of the set of sensing elements has a different axial orientation from another sensing element of the set of sensing elements, and wherein the set of sensing elements are part of one or more multi-component electromagnetic field sensors, and wherein the electromagnetic fields are caused by the pulses of electrical current originating at the bit;

deriving from the measurements of electromagnetic fields an estimate of a spark orientation at the bit and at least one electrical property of the formation; and displaying a log of the at least one electrical property as a function of bit position.

12. The method of claim 11, wherein the at least one electrical property is an isotropic at-bit formation resistivity or conductivity.

13. The method of claim 11, wherein the at least one electrical property comprises anisotropic formation resistivity components and orientation of an anisotropy axis.

14. The method of claim 11, wherein the at least one electrical property comprises a complex impedance or admittance.

15. The method of claim 11, wherein deriving the at least one electrical property comprises deriving a resistivity based on a signal phase and a signal ratio, wherein the signal phase is a phase difference between a first field measurement and a second field measurement, and wherein the signal ratio is a ratio of a magnitude of the first field measurement and a magnitude of the second field measurement, and wherein both the first field measurement and the second field measurement are complex measurements based on electromagnetic field measurements made by the one or more multi-component electromagnetic field sensors.

16. The method of claim 11, wherein the one or more multi-component electromagnetic field sensors are positioned in an additional well or borehole or at the earth's surface.

17. The method of claim 16, further comprising deriving a bit position based at least in part on the electromagnetic fields.

18. The method of claim 17, further comprising steering a path of the borehole at least partly in response to the bit position.

19. The method of claim 11, wherein the set of sensing elements comprise tilted coil antennas.

20. A non-transitory computer-readable storage medium having software, the software to cause a processor to:

extend a borehole through a formation in front of a bit by passing pulses of electrical current into the formation;

acquire measurements of electromagnetic fields using each of a set of sensing elements, wherein the set of sensing elements have at least one sensing element that is at a different axial orientation than another sensing element of the set of sensing elements, and wherein the set of sensing elements are part of a set of multi-component electromagnetic field sensors, and wherein the electromagnetic fields are caused by the pulses of electrical current originating at the bit;

derive a spark orientation at the bit and a set of electrical properties of the formation based on the measurements of electromagnetic fields; and display a log of the set of electrical properties as a function of bit position.

* * * * *